United States Patent [19]

De Gier et al.

[11] Patent Number: 5,062,227

[45] Date of Patent: Nov. 5, 1991

[54] DEVICE FOR BREAKING OBJECTS CONSISTING OF CONCRETE OR SIMILAR MATERIAL

[75] Inventors: Gertrudis M. G. De Gier, JZ Velddriel; Jan R. Sytstra, Am Papendrecht, both of Netherlands

[73] Assignee: Verachtert Beheer B.V., 's-Hertogenbosch, Netherlands

[21] Appl. No.: 538,726

[22] Filed: Jun. 15, 1990

[30] Foreign Application Priority Data

Jun. 20, 1989 [NL] Netherlands ..... 8901542

[51] Int. Cl.[5] ..... E02F 3/76; B66C 3/00

[52] U.S. Cl. ..... 37/117.5; 37/DIG. 3; 414/740; 294/104

[58] Field of Search ..... 37/2 R, 183 R, 184, 37/188, 117.5, DIG. 3; 414/739, 740; 294/104; 80/134; 241/101.7, 262, 263, 264

[56] References Cited

U.S. PATENT DOCUMENTS

| | | | |
|---|---|---|---|
| 3,275,172 | 9/1966 | Smith . | |
| 3,451,151 | 6/1969 | Guinot | 37/188 |
| 3,802,731 | 4/1974 | LaBounty | 294/104 |
| 3,807,589 | 4/1974 | Shovick | 37/2 R |
| 4,188,721 | 2/1980 | Ramun et al. | 414/740 |
| 4,198,747 | 4/1980 | LaBounty | 414/740 |
| 4,283,866 | 8/1981 | Ogawa | 37/117.5 |
| 4,403,431 | 9/1983 | Ramun et al. | 414/740 |
| 4,407,626 | 10/1983 | Bruckner | 37/117.5 |
| 4,439,921 | 4/1984 | Ramun et al. . | |
| 4,519,135 | 5/1985 | LaBounty | 37/117.5 |
| 4,558,515 | 12/1985 | LaBounty | 294/104 |
| 4,625,438 | 12/1986 | Mozer | 37/117.5 |
| 4,635,386 | 1/1987 | Kobayasi | 37/117.5 |
| 4,670,983 | 6/1987 | Ramun et al. | 414/740 |
| 4,686,767 | 8/1987 | Ramun et al. | 414/740 |
| 4,719,975 | 1/1988 | LaBounty | 414/740 |
| 4,897,921 | 2/1990 | Ramun | 414/740 |
| 4,907,356 | 3/1990 | LaBounty | 37/117.5 |
| 4,959,915 | 10/1990 | Roussin et al. | 37/DIG. 18 |

FOREIGN PATENT DOCUMENTS

| | | | |
|---|---|---|---|
| 2266770 | 4/1974 | France . | |
| 609845 | 6/1978 | U.S.S.R. | 37/117.5 |
| 1339208 | 9/1987 | U.S.S.R. | 37/117.5 |
| 2183193 | 6/1987 | United Kingdom . | |
| 8803213 | 10/1987 | World Int. Prop. O. . | |

*Primary Examiner*—Dennis L. Taylor
*Assistant Examiner*—Spence Warnick
*Attorney, Agent, or Firm*—Oblon, Spivak, McClelland, Maier & Neustadt

[57] ABSTRACT

The invention relates to a device for breaking objects such as concrete or similar material, which device is provided with a pair of jaws having teeth which are pivotable relative to each other about a pivot pin. The device is designed to be coupled to the end of the arm of an excavator or the like by use of a hinge pin. A strut is provided between a first jaw and the arm of the excavator, while a setting cylinder coupled to the arm of the excavator with one end is coupled to the second jaw with its other end, in such a manner that the second jaw can be pivoted towards and away from the first jaw by use of said setting cylinder. The device is thereby provided with a coupling piece to be coupled to the end of the arm of the excavator by use of the hinge pin, while the first jaw is connected with the coupling piece in a point which, when seen in the longitudinal direction of the hinge pin, is located between the hinge pin and the point of attachment of the strut to the first jaw. The device is furthermore provided with a further strut to be provided between the coupling piece and a point near the point of attachment of the strut to the arm of the excavator.

11 Claims, 3 Drawing Sheets

DEVICE FOR BREAKING OBJECTS CONSISTING OF CONCRETE OR SIMILAR MATERIAL

BACKGROUND OF THE INVENTION

1. Field of the Invention

The invention relates to a device for breaking objects consisting of concrete or similar material, which device is provided with a pair of jaws having teeth which are pivotable relative to each other about a pivot pin, said device being designed to be coupled to the end of the arm of an excavator or the like by means of a hinge pin, whereby a strut is provided between a first jaw and the arm of the excavator, whilst a setting cylinder coupled to the arm of the excavator with one end is coupled to the second jaw with its other end, in such a manner that the second jaw can be pivoted towards and away from the first jaw by means of said setting cylinder.

2. Discussion of the Background

Usual devices of the above kind are directly coupled to the end of the arm of the excavator or the like by means of the hinge pin, to which end there is normally pivotally coupled an excavator bucket or the like. The setting cylinder used for pivoting the excavator bucket, which is coupled to the arm with one end, is coupled to one of the jaws of the device in that case, while the other jaw is secured against pivoting about the hinge pin by means of the strut.

In practice it has become apparent that when such a device is used forces can be exerted on the arm of the excavator which are so high that the end of said arm buckles or even tears apart.

SUMMARY OF THE INVENTION

The object of the invention is to obtain a device of the above kind, wherein this drawback of the known devices can be overcome.

According to the invention this can be accomplished in that the device is provided with a coupling piece to be coupled to the end of the arm of the excavator by means of the hinge pin, while the first jaw is connected with the coupling piece in a point which, when seen in the longitudinal direction of the hinge pin, is located between the hinge pin and the point of attachment of the strut to the first jaw, and that the device is furthermore provided with a further strut to be provided between the coupling piece and a point near the point of attachment of the strut to the arm of the excavator.

When such a construction is used the forces exerted on the jaws when breaking concrete or similar material will be transmitted by the coupling rods at least largely externally of the arm of the excavator, as a result of which the occurrence of undersirable high loads on the arm of the excavator is avoided.

The invention furthermore relates to a device for breaking objects consisting of concrete or similar material, said device being provided with a pair of jaws having teeth, which are pivotable relative to each other about a pivot pin by means of a setting cylinder.

With the usual devices of this kind the teeth in fact only exert pressure forces on the concrete. In most cases, however, exerting shearing forces on the concrete appears to be more effective for breaking the concrete.

According to one aspect of the invention a certain relative movement between the teeth of the two jaws producing shearing forces can be effected when the jaws are being closed, when the connecting line between the points of the teeth located at the end of a row of teeth provided on a fixed jaw includes an angle with the connecting line between the pivot pin and the point of the tooth of the fixed jaw located furthest from the pivot pin.

According to another aspect of the invention the teeth of at least one of the jaws are for this purpose provided on a sliding piece which is movable along the jaw in question, to which sliding piece there is pivotally coupled one end of a coupling rod, while the other end of the coupling rod is pivotally coupled to the other jaw in a point located spaced from the pivot pin. When the jaws are being closed the sliding piece will automatically be moved relative to the jaw in question.

According to a further aspect of the invention means are provided by way of which the teeth of at least one of the jaws can be put into a vibrating motion with respect to the jaw. Also this appears to effect an effective breaking of concrete.

BRIEF DESCRIPTION OF THE DRAWINGS

The invention will be explained in more detail hereinafter with reference to a few possible embodiments of the construction according to the invention diagrammatically illustrated in the accompanying figures.

DESCRIPTION OF THE PREFERRED EMBODIMENTS

Figure 1:
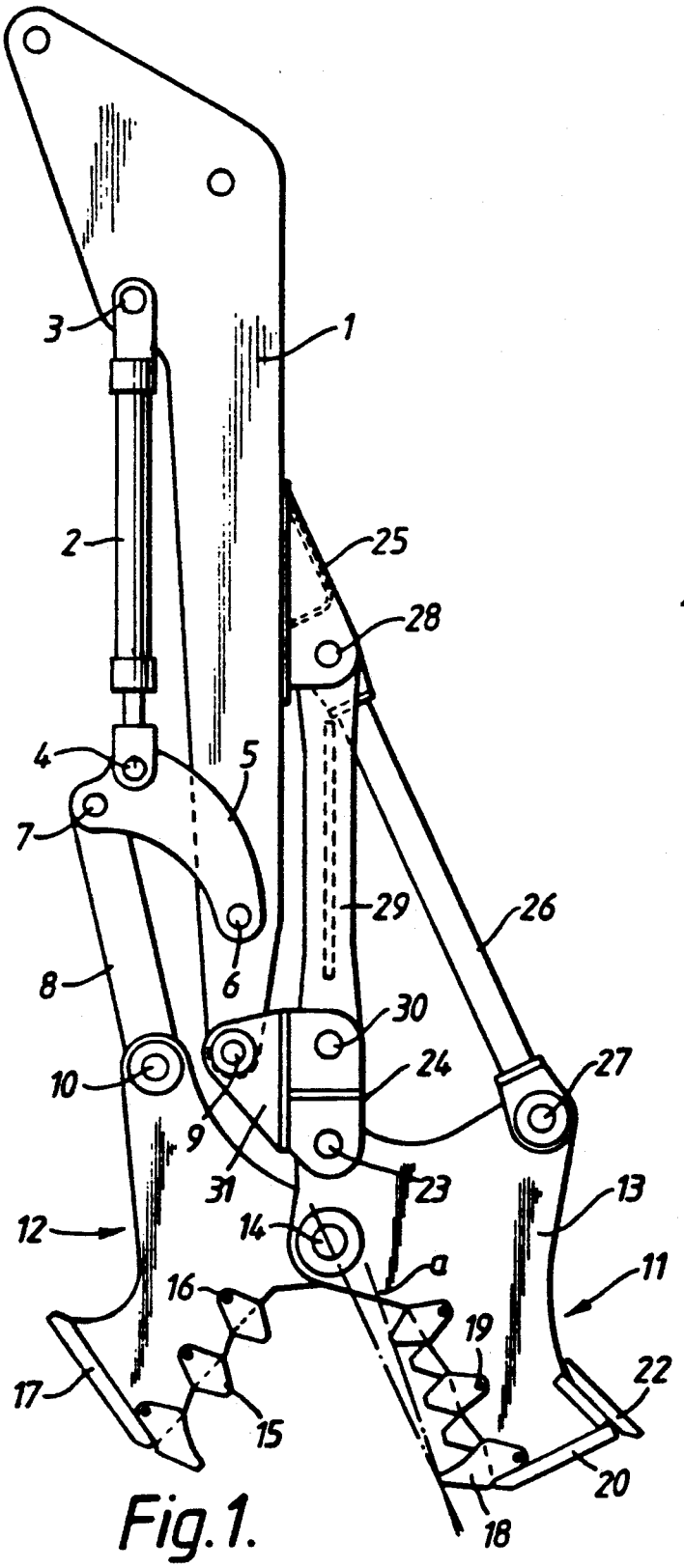
FIG. 1 is a side elevational view of an arm of an excavator with a device according to the invention coupled thereto.

FIG. 1 shows a side elevational view of an arm 1 of a hydraulic excavator or the like, which arm may be pivotally coupled with its upper end, when seen in FIG. 1, to a further arm connected with the frame of the excavator or the like.

The the arm 1 there is pivotally coupled in a usual manner, by means of a hinge pin 3, a hydraulic setting cylinder 2 only diagrammatically indicated by means of a chain-dotted line. The other end of the setting cylinder is pivotally coupled, by means of a hinge pin 4, to a connecting arm 5 which is coupled to the arm 1 by means of a hinge pin 6 at a short distance from the free end of said arm.

To the connecting piece 5 there is coupled one end of a coupling rod 8 by means of a further hinge pin 7.

In the free end of the arm 1 there is provided a hole, in which a hinge pin 9 is accommodated. During normal use of the excavator an excavator bucket or the like is coupled to the arm by means of said hing pin 9. The free end of the arm 8 is thereby also coupled to the excavator bucket by means of a further hinge pin 10, so that the excavator bucket in question can be pivoted relative to the arm 1 about the hinge pin 9 by means of the setting cylinder 2.

Instead of an excavator bucket a device 11 for breaking objects consisting of concrete or similar material is now coupled to the end of the arm 1 by means of the hinge pins 9 and 10. Said device 11 comprises in a usual manner a pair of jaws 12 and 13, which are pivotally coupled together by means of a pivot pin 14.

Figure 3:
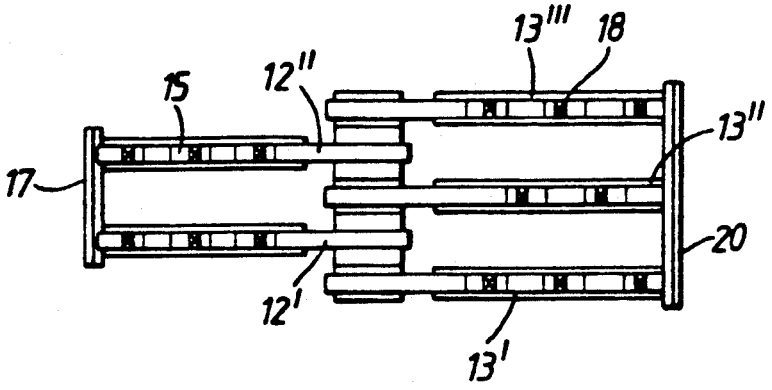
FIG. 3 is an elevational view of parts of the two jaws of the device.

As appears more particularly from FIG. 3 the jaw 12 thereby comprises a pair of plate-shaped means 12' and 12'', to which teeth 15 are preferably detachably secured by means of clamping pins 16. The free ensa of the plates 12' and 12'' are mutually connected by connecting plate 17.

The jaw 13 comprises three plates 13', 13'', 13''', to which teeth 18 are secured, said teeth 18 preferably being detachable by means of clamping pins 19. As can be seen in FIG. 3 only two teeth are thereby secured to the center plates 13'', which teeth are located intermediate the teeth secured to the two plates 13', and 13''', when seen in the direction of the pivot pin 14.

The ends of the plates 13', 13'' and 13''' are mutually connected by a pair of plates 20 and 21 including an angle with each other. A scraping blade 22 is detachably and reversibly secured to the plate 21, which scraping blade 22 projects beyond the end of the jaw 13 with one edge, as appears from FIG. 1, and which can be used during operation for scraping together material lying on the ground. In case of wear of the scraping edge the plate can be detached and reversed, so that the other edge is put in the position suitable for use.

The two jaws 12 and 13 are connected to a coupling piece 24 by means of a hinge pin 23 extending parallel to the pivot pin 14. Said coupling piece is in turn connected to the end of the arm 1 by means of the hinge pin 9.

Furthermore a first strut 26 is provided between the jaw 13 and a support 25 secured to the arm. Said strut 26 is thereby coupled to the jaw 13 by means of a hinge pin 27 extending parallel to the pivot pin 14, and coupled to the support 25 by means of a hinge pin 28 extending parallel to the pin 27.

to the support 25 there is furthermore coupled one end of a second strut 29, by means of the hinge pin 28. This strut, which extends at least substantially parallel to the longitudinal axis of the arm 1, as appears from FIG. 1, is coupled, with its end remote from the support 25, to the coupling piece 24 by means of a hinge pin 30.

As will furthermore be apparent from FIG. 1 the hinge pins 30 and 23 are positioned between the hinge pin 9 located near the end of the arm 1 and the hinge pin 27 by means of which the strut 26 is coupled to the jaw 13, when seen in the longitudinal direction of the various hinge pins.

Furthermore it will be apparent that the jaw 12 can be pivoted to and fro about the hinge pin 14 by means of the setting cylinder 2, while the jaw 13 will assume an at least substantially fixed position relative to the arm 1, so that this jaw is also called the so-called fixed jaw.

An object of concrete or similar material to be broken can be placed between the jaws 12 and 13 in the usual manner and be broken by moving said jaws together. The forces exerted on the pivot pin 14 will thereby be at least substantially transmitted to the hinge pin 28 and the connecting piece 25 via the coupling piece 24 and the strut 29, and exert a downward tensile force, seen in FIG. 1, on the hinge pin 28 and the connecting piece 25. Via the strut 26 there will furthermore be exerted a pressure force on the hinge pin 28 and the support 25, whereby the tensile force and the pressure force exerted at the location of the hinge pin 28 will eliminate each other more or less and it is thus prevented that undersirable forces are exerted on the arm 1 of the excavator.

It is noted that the lugs 31 of the coupling piece, through which the hinge pin 9 is passed for attaching the coupling piece 24 to the end of the arm 1, may be detachably connected to the other part of the coupling piece 24. By providing suitable lugs 31 the coupling piece 24 can be simply and quickly adaped to arms 1 associated with various excavators, so that a standard model of the device according to the invention can be made and said device can be adapted to the excavator to which the device in question is to be coupled merely by providing suitable lugs 31.

As is furthermore indicated in FIG. 1 the connecting line a between the points of the farthest positioned teeth of the row of teeth provided on the fixed jaw 13 extends at some distance from the central axis of the pivot pin 14, at the side of said pivot pin 14 remote from the pivotable jaw 12, when the jaws are in their open position. In other words, said line forms an angle with respect to the connecting line between the central axis of the pivot pin 14 and the point fo the outermost tooth of the jaw 13. As a result of this arrangement it is achieved that near the end of the pivoting motion of the teeth of the two jaws towards each other, the teeth 15 of the pivotable jaw 12 slightly move in the direction of the pivot pin 14, as it were, and as a result carry out a shearing action on the object to be broken.

It will be apparent that this phenomenon can also be utilized when the fixed jaw 13 is directly coupled to the end of the arm 1 by the hinge pin 9, instead of being coupled by means of the coupling piece 24 and the strut 29, which hinge pin 9 is in that case passed through the hole in the fixed jaw 13, in which the hinge pin 23 is now present.

Figure 2:
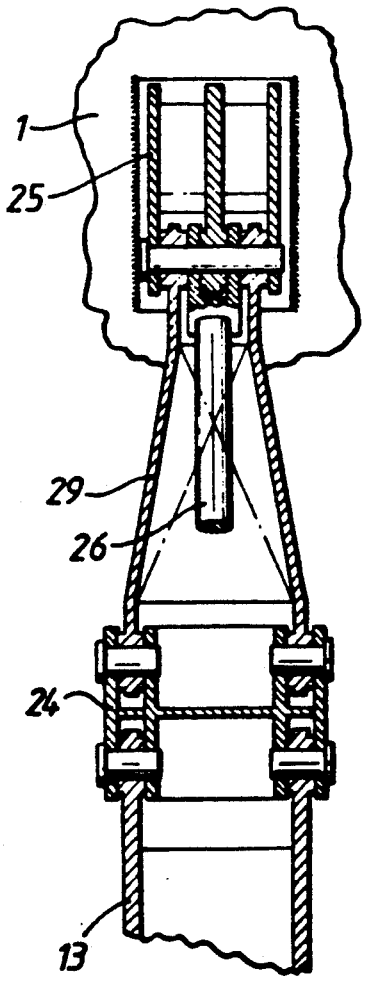
FIG. 2 is a side elevational view of a few of the parts illustrated in FIG. 1.
Figure 4:
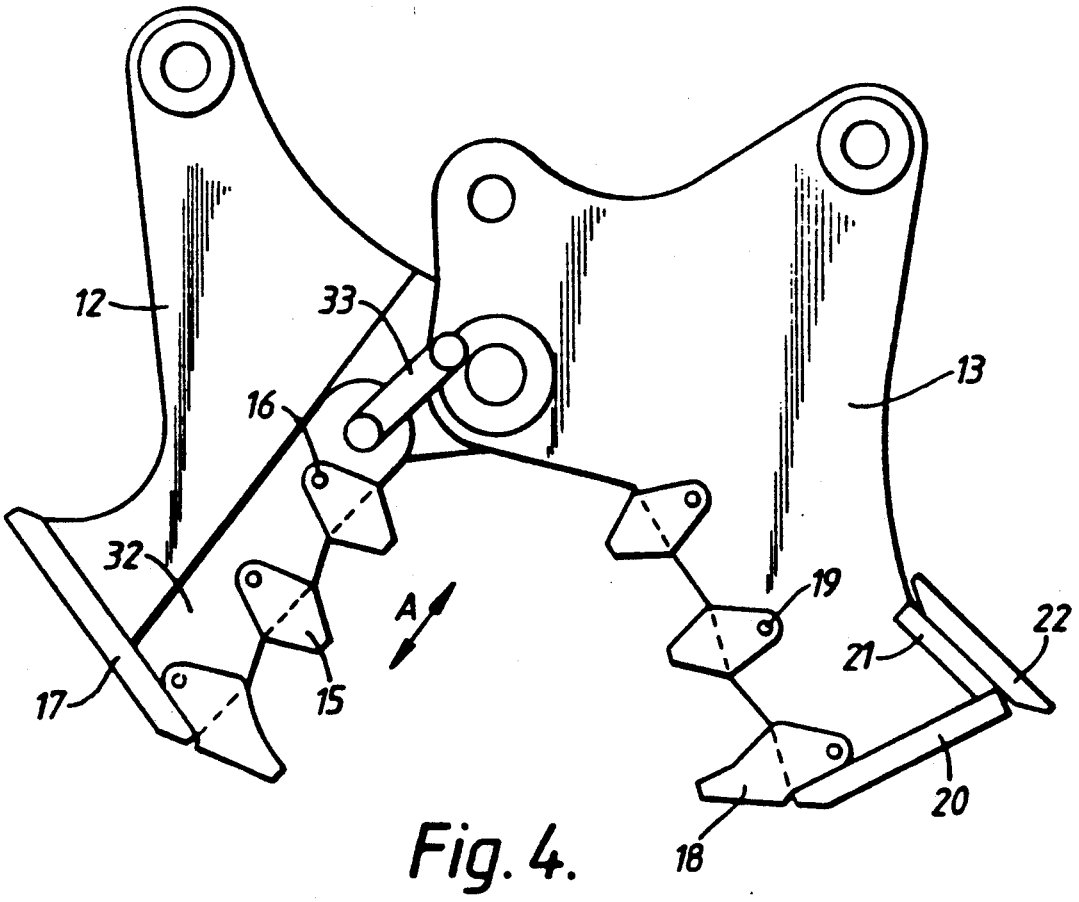
FIG. 4 shows the jaws of a second embodiment of a device according to the invention, said jaws being illustrated in their open position.
Figure 5:
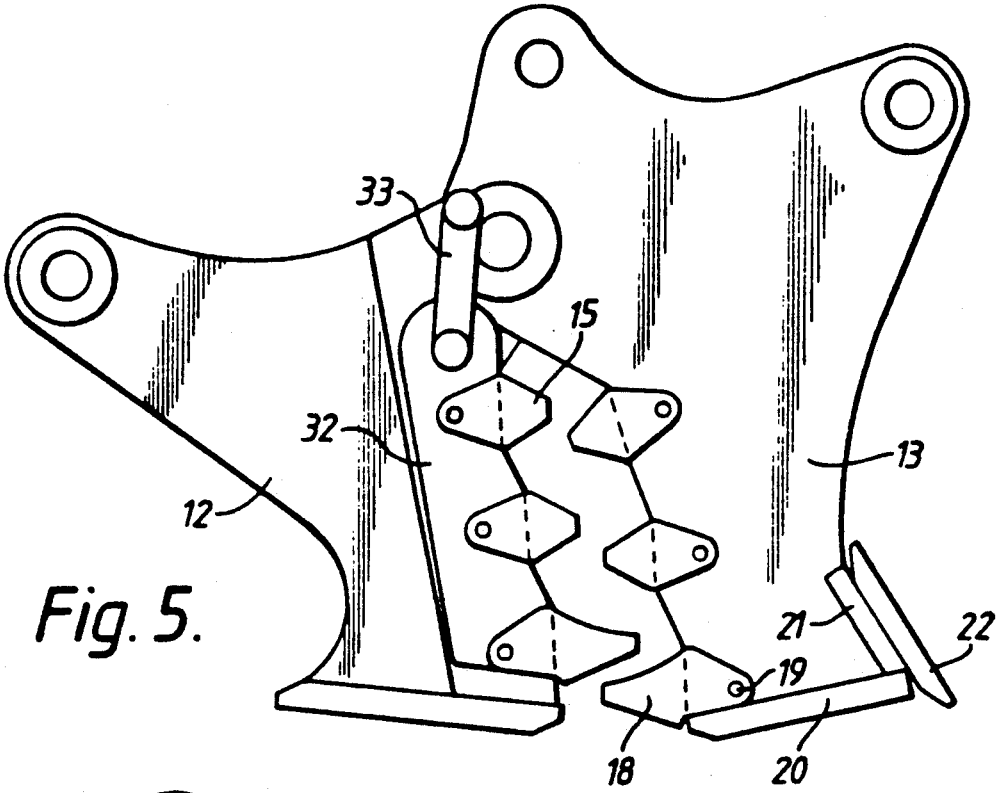
FIG. 5 shows the jaws illustrated in FIG. 4 in an at least substantially closed position of said jaws.

In the embodiment illustrated in the FIGS. 4 and 5 those parts that correspond with the parts discussed above with reference to FIGS. 1-3 have been given the same reference numbers as in said FIGS. 1-3. This also applies to the embodiment according to FIG. 6 which is to be discussed in more detail hereinafter.

As is diagrammatically illustrated in the FIGS. 4 and 5 the teeth 15 of the movable jaw are in this embodiment secured to a sliding piece 32, which is connected with the moveable jaw 12 in such a manner that said sliding piece 32 is movable to end fro in its longitudinal direction relative to the movable jaw or, in other words, approximately parallel to the longitudinal direction of the row of teeth, as is indicated by means of the double arrow A. At the end of the sliding piece 32 located near the pivot pin 14 said sliding piece 32 is pivotally coupled to one end of a coupling rod 33. The other end of said coupling rod 33 is pivotally coupled to the fixed jaw 13 at some distance from the central axis of the pivot pin 14.

As will be apparent from a comparison of FIGS. 4 and 5, the sliding piece 32, with the teeth 15 secured thereto, will automatically be moved in a direction towards the pivot pin 14 when the two jaws 12 and 13 pivot towards each other, whilst when the two jaws 12 and 13 move away from each other the sliding piece 32 with the teeth 15 secured thereto will automatically be moved back into the position illustrated in FIG. 4. As a result of said sliding motion of the teeth 14 the breaking of concrete or the like will be favourably influenced.

Figure 6:
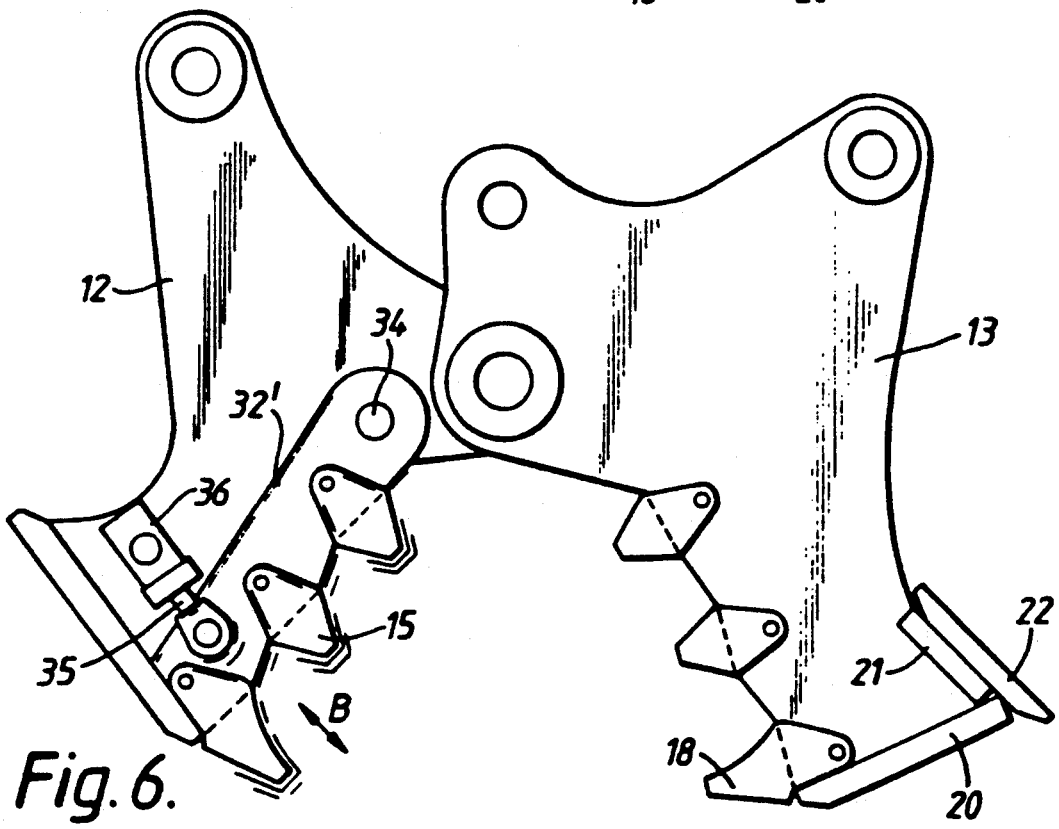
FIG. 6 is an elevational view of the jaws of a further embodiment of a device according to the invention.

With the embodiment according to FIG. 6 the teeth 15 of the movable jaw 12 are secuared to a carrier 32', which is coupled to the movable jaw 12 by means of a hinge pin 34 extending parallel to the pivot pin 14. The end of the carrier 32' remote from the hinge pin 34 is coupled to the end of a piston rod 35 of a setting cylinder 36 connected with the jaw 12. In this manner the carrier 32' with the teeth 15 secured thereto can be put into a reciprocating vibrating motion about the hinge pin 34 by means of said setting cylinder, as indicated by the double arrow B. Also such a vibrating motion of the teeth 15 appears to have an advantageous effect on the breaking of concrete or the like.

Of course it will be possible within the scope of the invention to use various of the above measures also in combination with one another.

What is claimed as new and desired to be secured by Letters Patent of the United States is:

1. A device for breaking objects, which comprises:
an excavator arm;
a pair of jaws having teeth, said jaws including a first fixed jaw and a second pivotable jaw;
a pivot pin for pivotably interconnecting said jaws;
a first hinge pin for mounting said jaws of said arm;
a first strut connecting said first fixed jaw to the arm
a setting cylinder having a first end coupled to the arm and having a second end coupled to the second jaw such that the second jaw is pivotable toward and away from the first fixed jaw by means of said setting cylinder;
a coupling piece coupled to an end of the arm by means of the first hinge pin wherein the first fixed jaw is connected to the coupling piece at a point which is located between the first hinge pin and a point of attachment of the first strut to the first jaw; and a second strut interconnecting the coupling piece and an end of the first strut.

2. A device according to claim 1, which comprises a second hinge pin for coupling said second strut to said coupling piece at a point located above a point of attachment of the first jaw to the coupling piece.

3. A device according to claims 2, which comprises a third hinge pin for coupling the first and second struts to the arm.

4. A device according to claim 1, which comprises a third hinge pin for connecting the first jaw to the coupling piece and a fourth and fifth hinge pin respectively connected to the second strut and to the arm wherein a central axis of the pivot pin connecting the two jaws together and central axes of the third, fourth and fifth hinge pins are located in substantially a single plane.

5. A device according to claim 1, wherein the coupling piece comprises a plurality of exchangeable lugs for coupling the coupling piece to an end portion of the arm.

6. A device according to claim 1, wherein said teeth are exchangeably mounted on said first and second jaws.

7. A device according to claim 1, which comprises an exchangeable scraping blade connected to said first jaw.

8. A device according to claim 7, which comprises means for positioning said scraping blade in a plurality of scraping positions on said first jaw.

9. A device for breaking objects, which comprises:
first and second jaws, each jaw having teeth;
a pivot pin for pivotably interconnecting the jaws;
a setting cylinder for moving the second jaw about the pivot pin;
said second jaw having a sliding piece mounted thereon upon which said teeth of said second jaw are mounted;
a coupling rod pivotably connected to said sliding piece and to said second jaw at a point spaced from said pivot pin.

10. A device according to claim 1, which comprises:
means connected to the second jaw for vibrating the teeth of the second jaw.

11. A device according to claim 1, wherein a connecting line between points of teeth of a row of teeth mounted on the first fixed jaw forms an angle with respect to a connecting line between the pivot pin and a point of a tooth of the first fixed jaw located furthest from the pivot pin.

* * * * *